United States Patent [19]

Glandt

[11] Patent Number: 5,046,559

[45] Date of Patent: Sep. 10, 1991

[54] METHOD AND APPARATUS FOR PRODUCING HYDROCARBON BEARING DEPOSITS IN FORMATIONS HAVING SHALE LAYERS

[75] Inventor: Carlos A. Glandt, Houston, Tex.

[73] Assignee: Shell Oil Company, Houston, Tex.

[21] Appl. No.: 571,381

[22] Filed: Aug. 23, 1990

[51] Int. Cl.[5] ..... E21B 43/24

[52] U.S. Cl. ..... 166/248; 166/50; 166/60; 166/272

[58] Field of Search ..... 166/50, 60, 65.1, 248, 166/250, 272, 263, 302, 303

[56] References Cited

U.S. PATENT DOCUMENTS

| | | | |
|---|---|---|---|
| Re. 30,738 | 9/1981 | Bridges et al. | 166/248 |
| 3,642,066 | 2/1972 | Gill | 166/248 |
| 3,848,671 | 11/1974 | Kern | 166/248 |
| 3,874,450 | 4/1975 | Kern | 166/248 |
| 3,958,636 | 5/1976 | Perkins | 166/248 |
| 3,986,557 | 10/1976 | Striegler et al. | 166/272 |
| 3,994,340 | 11/1976 | Anderson et al. | 166/272 |
| 4,037,658 | 7/1977 | Anderson | 166/272 |
| 4,085,803 | 4/1978 | Butler | 166/303 |
| 4,116,275 | 9/1978 | Butler et al. | 166/303 |
| 4,344,485 | 8/1982 | Butler | 166/50 X |
| 4,401,162 | 8/1983 | Osborne | 166/60 X |
| 4,470,459 | 9/1984 | Copland | 166/50 X |
| 4,545,435 | 10/1985 | Bridges et al. | 166/50 X |
| 4,550,779 | 11/1985 | Zakiewicz | 166/306 X |
| 4,612,988 | 9/1986 | Segalman | 166/248 |
| 4,705,108 | 11/1987 | Little et al. | 166/280 X |
| 4,850,429 | 7/1989 | Mims et al. | 166/50 X |
| 4,926,941 | 5/1990 | Glandt et al. | 166/60 X |

OTHER PUBLICATIONS

Towson, "The Electric Preheat Recovery Process," Second International Conference on Heavy Crude and Tar Sand, Caracas, Venezuela, Sep. 1982.

Hiebert et al., "Numerical Simulation Results for the Electrical Heating of Athabasca Oil Sand Formations," *Reservoir Engineering Journal*, SPE Jan. 1986.

*Primary Examiner*—George A. Suchfield

[57] ABSTRACT

An apparatus and method are disclosed for producing thick tar sand deposits by electrically preheating paths of increased injectivity between an injector and producers, wherein the injector and producers are arranged in a triangular pattern with the injector located at the apex and the producers located on the base of the triangle. These paths of increased injectivity are then steam flooded to produce the hydrocarbons.

10 Claims, 5 Drawing Sheets

METHOD AND APPARATUS FOR PRODUCING HYDROCARBON BEARING DEPOSITS IN FORMATIONS HAVING SHALE LAYERS

BACKGROUND OF THE INVENTION

This invention relates to an apparatus and method for the production of hydrocarbons from earth formations, and more particularly, to those hydrocarbon-bearing deposits where the oil viscosity and saturation are so high that sufficient steam injectivity cannot be obtained by current steam injection methods. Most particularly this invention relates to an apparatus and method for the production of hydrocarbons from tar sand deposits having vertical hydraulic connectivity between the various geologic sequences.

In many parts of the world reservoirs are abundant in heavy oil and tar sands. For example, those in Alberta, Canada; Utah and California in the United States; the Orinoco Belt of Venezuela; and the USSR. Such tar sand deposits contain an energy potential estimated to be quite great, with the total world reserve of tar sand deposits estimated to be 2,100 billion barrels of oil, of which about 980 billion are located in Alberta, Canada, and of which 18 billion barrels of oil are present in shallow deposits in the United States.

Conventional recovery of hydrocarbons from heavy oil deposits is generally accomplished by steam injection to swell and lower the viscosity of the crude to the point where it can be pushed toward the production wells. In those reservoirs where steam injectivity is high enough, this is a very efficient means of heating and producing the formation. Unfortunately, a large number of reservoirs contain tar of sufficiently high viscosity and saturation that initial steam injectivity is severely limited, so that even with a number of "huff-and-puff" pressure cycles, very little steam can be injected into the deposit without exceeding the formation fracturing pressure. Most of these tar sand deposits have previously not been capable of economic production.

In steam flooding deposits with low injectivity the major hurdle to production is establishing and maintaining a flow channel between injection and production wells. Several proposals have been made to provide horizontal wells or conduits within a tar sand deposit to deliver hot fluids such as steam into the deposit, thereby heating and reducing the viscosity of the bitumen in tar sands adjacent to the horizontal well or conduit. U.S. Pat. No. 3,986,557 discloses use of such a conduit with a perforated section to allow entry of steam into, and drainage of mobilized tar out of, the tar sand deposit. U.S. Pat. Nos. 3,994,340 and 4,037,658 disclose use of such conduits or wells simply to heat an adjacent portion of deposit, thereby allowing injection of steam into the mobilized portions of the tar sand deposit.

U.S. Pat. No. 4,344,485 discloses a method for continuously producing viscous hydrocarbons by gravity drainage while injecting heated fluids. One embodiment discloses two wells which are drilled into the deposit, with an injector located directly above the producer. Steam is injected via the injection well to heat the formation. A very large steam saturated volume known as a steam chamber is formed in the formation adjacent to the injector. As the steam condenses and gives up its heat to the formation, the viscous hydrocarbons are mobilized and drain by gravity toward the production well (steam assisted gravity drainage or "SAGD"). Unfortunately the SAGD process is limited because the wells must generally be placed fairly close together and is very sensitive to and hindered by the existance of shale layers in the vicinity of the wells.

Several prior art proposals designed to overcome steam injectivity have been made for various means of electrical or electromagnetic heating of tar sands. One category of such proposals has involved the placement of electrodes in conventional injection and production wells between which an electric current is passed to heat the formation and mobilize the tar. This concept is disclosed in U.S. Pat. Nos. 3,848,671 and 3,958,636. A similar concept has been presented by Towson at the Second International Conference on Heavy Crude and Tar Sand (UNITAR/UNDP Information Center, Caracas, Venezuela, September, 1982). A novel variation, employing aquifers above and below a viscous hydrocarbon-bearing formation, is disclosed in U.S. Pat. No. 4,612,988. In U.S. Pat. No. Re. 30,738, Bridges and Taflove disclose a system and method for in-situ heat processing of hydrocarbonaceous earth formations utilizing a plurality of elongated electrodes inserted in the formation and bounding a particular volume of a formation. A radio frequency electrical field is used to dielectrically heat the deposit. The electrode array is designed to generate uniform controlled heating throughout the bounded volume.

In U.S. Pat. No. 4,545,435, Bridges and Taflove again disclose a waveguide structure bounding a particular volume of earth formation. The waveguide is formed of rows of elongated electrodes in a "dense array" defined such that the spacing between rows is greater than the distance between electrodes in a row. In order to prevent vaporization of water at the electrodes, at least two adjacent rows of electrodes are kept at the same potential. The block of the formation between these equipotential rows is not heated electrically and acts as a heat sink for the electrodes. Electrical power is supplied at a relatively low frequency (60 Hz or below) and heating is by electric conduction rather than dielectric displacement currents. The temperature at the electrodes is controlled below the vaporization point of water to maintain an electrically conducting path between the electrodes and the formation. Again, the "dense array" of electrodes is designed to generate relatively uniform heating throughout the bounded volume.

Hiebert et al ("Numerical Simulation Results for the Electrical Heating of Athabasca Oil Sand Formations," Reservoir Engineering Journal, Society of Petroleum Engineers, January, 1986) focus on the effect of electrode placement on the electric heating process. They depict the oil or tar sand as a highly resistive material interspersed with conductive water sands and shale layers. Hiebert et al propose to use the adjacent cap and base rocks (relatively thick, conductive water sands and shales) as an extended electrode sandwich to uniformly heat the oil sand formation from above and below.

These examples show that previous electrode heating proposals have concentrated on achieving substantially uniform heating in a block of a formation so as to avoid overheating selected intervals. The common conception is that it is wasteful and uneconomic to generate nonuniform electric heating in the deposit. The electrode array utilized by prior inventors therefore bounds a particular volume of earth formation in order to achieve this uniform heating. However, the process of uniformly heating a block of tar sands by electrical means is extremely uneconomic. Since conversion of fossil fuel energy to electrical power is only about 38 percent efficient, a significant energy loss occurs in heating an entire tar sand deposit with electrical energy.

U.S. Pat. No. 4,926,941 (Glandt et al) discloses electric preheating of a thin layer by contacting the thin layer with a multiplicity of vertical electrodes spaced along the layer.

It is therefore an object of this invention to provide an efficient and economic method of in-situ heat processing of tar sand and other heavy oil deposits, that will overcome any steam injectivity problems, and have an insensitivity to discontinuous shale barriers. It is a further object of this invention to provide an efficient and economic method of in-situ heat processing of tar sand and other heavy oil deposits, wherein electrical current is used to heat a path between a steam injector and two or more producers to establish thermal communication, and then to efficiently utilize steam injection to mobilize and recover a substantial portion of the heavy oil and tar contained in the deposit.

SUMMARY OF THE INVENTION

In accordance with the present invention, an improved thermal recovery process is provided to alleviate the above-mentioned disadvantages; the process continuously recovers viscous hydrocarbons by electric preheating followed by gravity drainage from a subterranean formation with heated fluid injection.

According to this invention there is provided a process for recovering hydrocarbons from hydrocarbon bearing deposits comprising:

providing at least two horizontal production wells near the bottom of a target production area, wherein the wells are horizontal electrodes during an electrical heating stage, and production wells during a production stage;

providing a horizontal injector well located between and above the producer wells, wherein the well is a horizontal electrode during an electrical heating stage, and an injection well during a production stage;

electrically exciting the electrodes during a heating stage such that current flows between the horizontal injection well and the horizontal production wells, creating preheated paths of increased injectivity;

injecting a hot fluid into the preheated paths displacing hydrocarbons toward the producers; and recovering hydrocarbons from the production wells.

Further according to this invention there is provided an apparatus for recovering hydrocarbons from hydrocarbon bearing deposits comprising:

at least two horizontal production wells situated near the bottom of a target production area, wherein the wells are horizontal electrodes during an electrical heating stage, and production wells during a production stage; and, a horizontal injection well located between and above the production wells, wherein the well is a horizontal electrode during an electrical heating stage, and an injection well during a production stage.

Still further according to this invention there is provided a process for increasing injectivity of hydrocarbon bearing deposits comprising:

providing at least two horizontal production wells near the bottom of a target production area, wherein the wells are horizontal electrodes during an electrical heating stage;

providing a horizontal injection well located between and above the producion wells, wherein the well is a horizontal electrode during an electrical heating stage;

electrically exciting the electrodes during a heating stage such that current flows between the horizontal injection well and the horizontal production wells, creating preheated paths of increased injectivity;

DETAILED DESCRIPTION OF THE INVENTION

Figure 1:
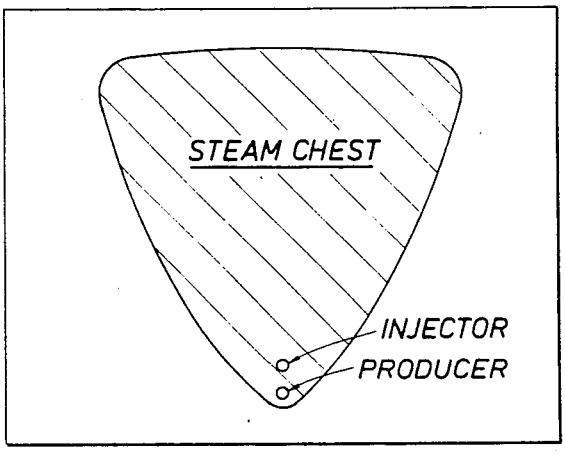
FIG. 1 (PRIOR ART)
FIG. 1 is a horizontal cross-section view of the steam assisted gravity drainage (SAGD) method showing the wells and the steam chest.

Although this invention may be used in any formation, it is particularly applicable to deposits of heavy oil, such as tar sands, which have vertical hydraulic connectivity and are interspersed with discontinuous shale barriers.

The steam assisted gravity drainage (SAGD) process disclosed in U.S. Pat. No. 4,344,485, discussed above, is a method for continuously producing viscous hydrocarbons by gravity drainage while injecting heated fluids. As discussed above, the SAGD process is limited by the requirement that the wells be placed relatively close together and is very sensitive to and hindered by the existance of shale layers between the producer and injector. The present invention, utilizing electric preheating and a unique arrangement of wells overcomes the limitations of U.S. Pat. No. 4,344,485.

Although any suitable number of wells and any suitable well pattern could be used, the number of electrodes and the well pattern will be determined by an economic optimum which depends, in turn, on the cost of the electrode wells and the conductivity of the tar sand deposit. Heavy oil recovery is most frequently production limited and therefore benefits from a ratio of production wells to injection wells greater than one. The invention preferably employs sets of three wells, one injector and two producers, preferably in a triangular arrangement. The producers are placed at the base of the triangle at the bottom of the production pay, in the range of about 30 to about 200 feet apart, preferably in the range of about 70 to about 150 feet apart, and most preferably in the range of about 90 to about 120 feet apart. The injector is at the top apex, in the range of about 30 to about 100 feet from the base, preferaby in the range of about 45 to about 60 feet from the base. Typical distances between injector and producer (side of the triangle) are in the range of about 30 to about 140 feet apart.

The producers are typically placed to maximize the potential hydrocarbon payout. To compare layers to determine their relative hydrocarbon richness the product of the oil saturation of the layer ($S_o$), porosity of the layer ($\Phi$), and the thickness of the layer is used. Most preferably, the producers are placed in the richest hydrocarbon layer. The producers are located preferably near the bottom of a thick segment of tar sand deposit, so that steam can rise up through the deposit and heated oil can drain down into the wells.

The horizontal wells in this invention will double as horizontal electrodes during the electrical heating stage, and as either injection or production wells during the steam injection and production stages. This is generally accomplished by using a horizontal well, and converting it to double as a horizontal electrode by using conductive liner, well casing or cement, and exciting it with an electrical current. For example, electrically conductive Portland cement with high salt content or graphite filler, aluminum-filled electrically conductive epoxy, or saturated brine electrolyte, which serves to physically enlarge the effective diameter of the electrode and reduce overheating. As another alternative, the conductive cement between the electrode and the formation may be filled with metal filler to further improve conductivity. In still another alternative, the electrode may include metal fins, coiled wire, or coiled foil which may be connected to a conductive liner and connected to the sand. The vertical run of the well is generally made non-conductive with the formation by use of a non-conductive cement.

During the electrical preheating stage power is supplied to the horizontal electrodes. The electric potentials are such that current will travel between the injector and the producers only, and not between producers. Although not necessary, the producers are generally in a plane at or near in depth to the bottom of the target production zone. The horizontal electrodes are positioned so that the electrodes are generally parallel to each other.

Power is generally supplied from a surface power source. Almost any frequency of electrical power may be used. Preferably, commonly available low-frequency electrical power, about 60 Hz, is preferred since it is readily available and probably more economic. Generally any voltage potentials that will allow for heating between the injector and the producer can be used. Typically the voltage differential between the injector and the producer will be in the range of about 100 to about 1200 volts. Preferably the voltage differential is in the range of about 200 to about 1000 volts and most preferably in the range of about 500 to about 700 volts.

While the formation is being electrically heated, surface measurements are made of the current flow into each electrode. Generally all of the electrodes are energized from a common voltage source, so that as the tar sand layers heat and become more conductive, the current will steadily increase. Measurements of the current entering the electrodes can be used to monitor the progress of the preheating process. The electrode current will increase steadily until vaporization of water occurs at the electrode, at which time a drop in current will be observed. Additionally, temperature monitoring wells and/or numerical simulations may be used to determine the optimum time to commence steam injection. The preheating phase should be completed within a short period of time.

As the preheated zone is electrically heated, the conductivity of the zone will increase. This concentrates heating in those zones. In fact, for shallow deposits the conductivity may increase by as much as a factor of three when the temperature of the deposit increases from 20° C. to 100° C. For deeper deposits, where the water vaporization temperature is higher due to increased fluid pressure, the increase in conductivity can be even greater. Consequently, the preheated zones heat rapidly. As a result of preheating, the viscosity of the tar in the preheated zone is reduced, and therefore the preheated zone has increased injectivity. The total preheating phase is completed in a relatively short period of time, preferably no more than about two years, and is then followed by injection of steam and/or other fluids.

To decrease the length of the electric heating phase, it is desired to simultaneously steam soak the wells while electrically heating. However, since the horizontal wells double as horizontal electrodes and horizontal injectors or producers, it is difficult to steam soak while the wells are electrified. If precautions are taken to insulate the surface facilities, the wells could be steam soaked while electrically preheating.

Once sufficient mobility is established, the electrical heating is discontinued and the preheated zone produced by conventional injection techniques, injecting fluids into the formation through the injection wells and producing through the production wells. The area inside and around the triangle has been heated to very low tar viscosities and is produced very quickly. Produced fluids are replaced by steam creating an effective enlarged production/injection radius or "steam chest" shown in FIG. 2. Fluids other than steam, such as hot air or other gases, or hot water, may also be used to mobilize the hydrocarbons, and/or to drive the hydrocarbons to production wells.

The subsequent steam injection phase begins with continuous steam injection within the preheated zone where the tar viscosity is lowest. The steam flowing into the tar sand deposit effectively displaces oil toward the production wells. The steam injection and recovery phase of the process may take a number of years to complete. The existence of vertical communication encourages the transfer of heat vertically in the formation.

EXAMPLE

For geological reasons, shale layers are almost always found within a tar sand deposit because the tar sands were deposited as alluvial fill within the shale. The following example is designed to compare the EP-SAGD process against the SAGD process for various geological settings.

Numerical simulations were used to compare the EP-SAGD process to the SAGD process. These simulations required an input function of viscosity versus temperature. For example, the viscosity at 15° C. is about 1.26 million cp, whereas the viscosity at 105° C. is reduced to about 193.9 cp. In a sand with a permeability of 3 darcies, steam at typical field conditions can be injected continuously once the viscosity of the tar is reduced to about 10,000 cp, which occurs at a temperature of about 50° C. Also, where initial injectivity is limited, a few "huff-and-puff" steam injection cycles may be sufficient to overcome localized high viscosity. Table 1 shows the parameters for the simulations.

TABLE 1

| | EP-SAGD | SAGD |
|---|---|---|
| Heating time, yr | 1 | N/A |
| Voltage differential, volts | 620 | N/A |
| Resistivity of formation, ohm-m | 100 | 100 |
| Electrode/well distances | | |
| producer - producer, ft | 90 | N/A |
| producer - injector, ft | 60 | 15 |
| Thickness of formation, ft | 100 | 100 |

TABLE 1-continued

| | EP-SAGD | SAGD |
|---|---|---|
| Drainage width, ft | 300 | 200 |
| Oil saturation, % | 85 | 85 |
| Water saturation, % | 15 | 15 |
| Injection pressure, psi | 400 | 400 |
| Maximum steam production, bbl/ft-day | 0.03 | 0.03 |
| Quality of injected steam | 0.80 | 0.80 |

The amount of electrical power generated in a volume of material, such as a subterranean, hydrocarbon-bearing deposit, is given by the expression:

$$P=CE^2$$

where P is the power generated, C is the conductivity, and E is the electric field intensity. For constant potential boundary conditions, such as those maintained at the electrodes, the electric field distribution is set by the geometry of the electrode array. The heating is then determined by the conductivity distribution of the deposit. The more conductive layers in the deposit will heat more rapidly. Moreover, as the temperature of a particular area rises, the conductivity of that heated area increases, so that the heated areas will generate heat still more rapidly than the surrounding areas. This continues until vaporization of water occurs in that area, at which time its conductivity will decrease. Consequently, it is preferred to keep the temperature within the area to be heated below the boiling point of water at the insitu pressure.

Figure 2:
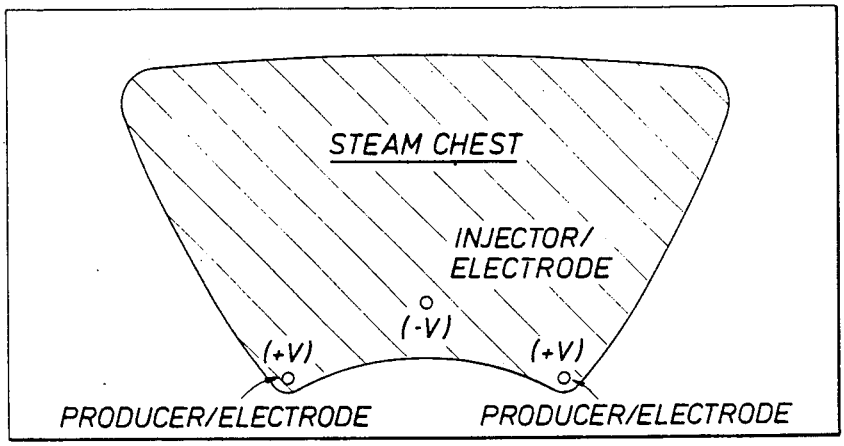
FIG. 2 is a horizontal cross-section views of the electrical preheat steam assisted gravity drainage (EP-SAGD) method showing the wells and the steam chest.
Figure 3:
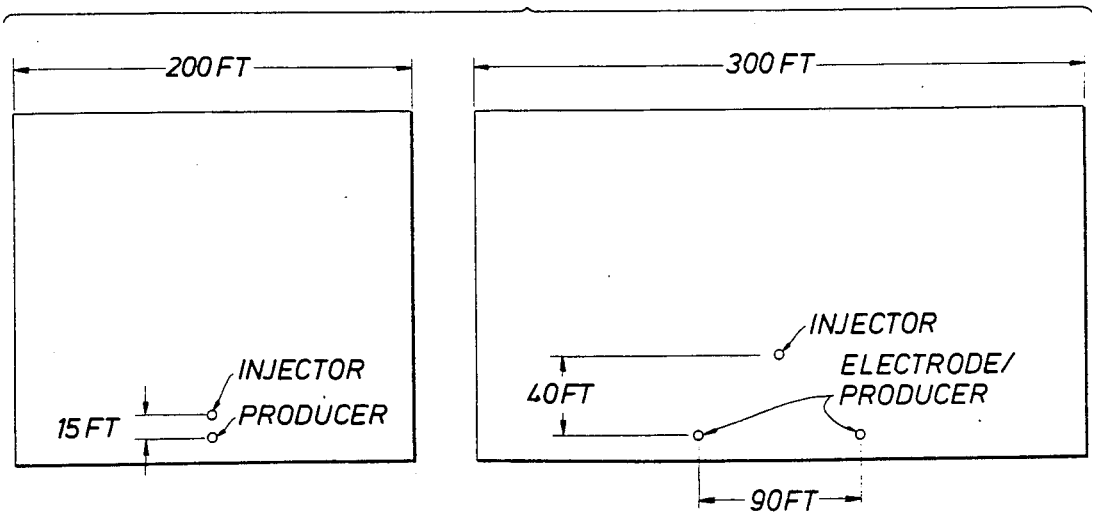
FIG. 3 shows a well configuration comparison between the SAGD process and the EP-SAGD process.
Figure 4:
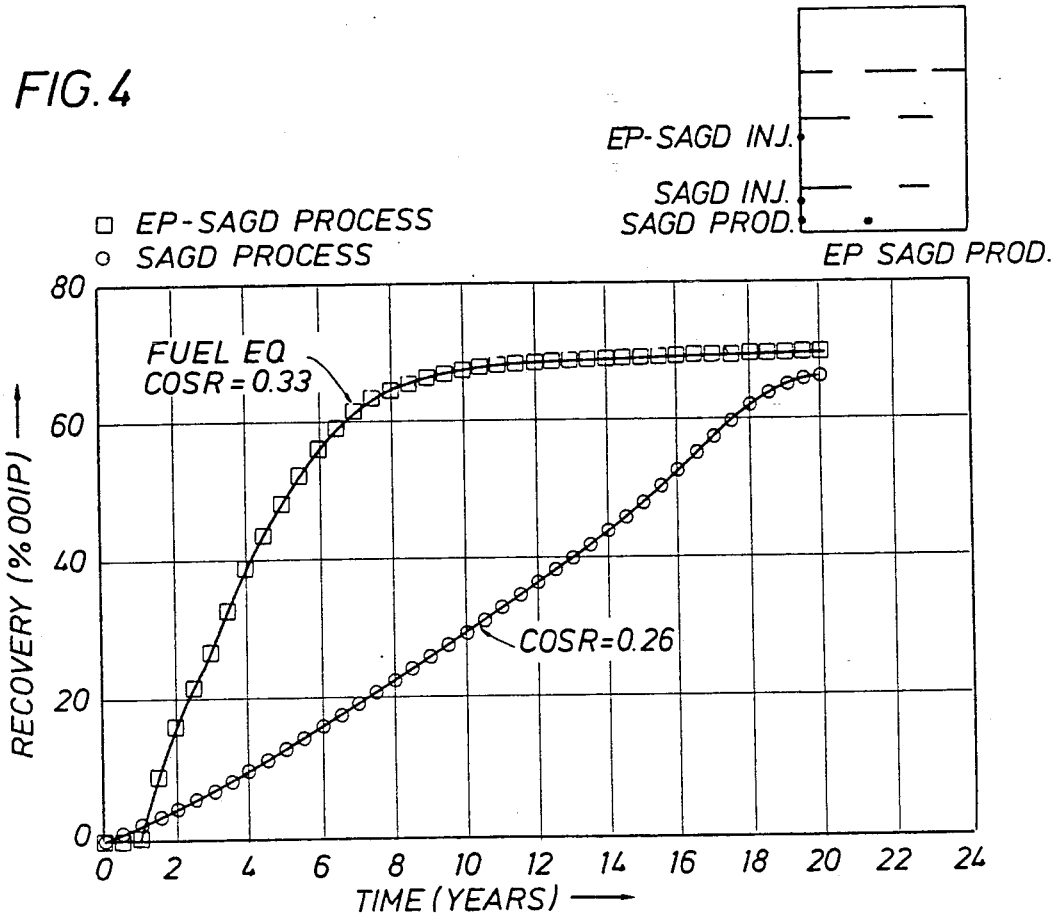
FIGS. 4–11 show the recovery of the original oil in place (OOIP) of the reservoir as a function of time for various geological settings for the SAGD and EP-SAGD processes.
Figure 5:
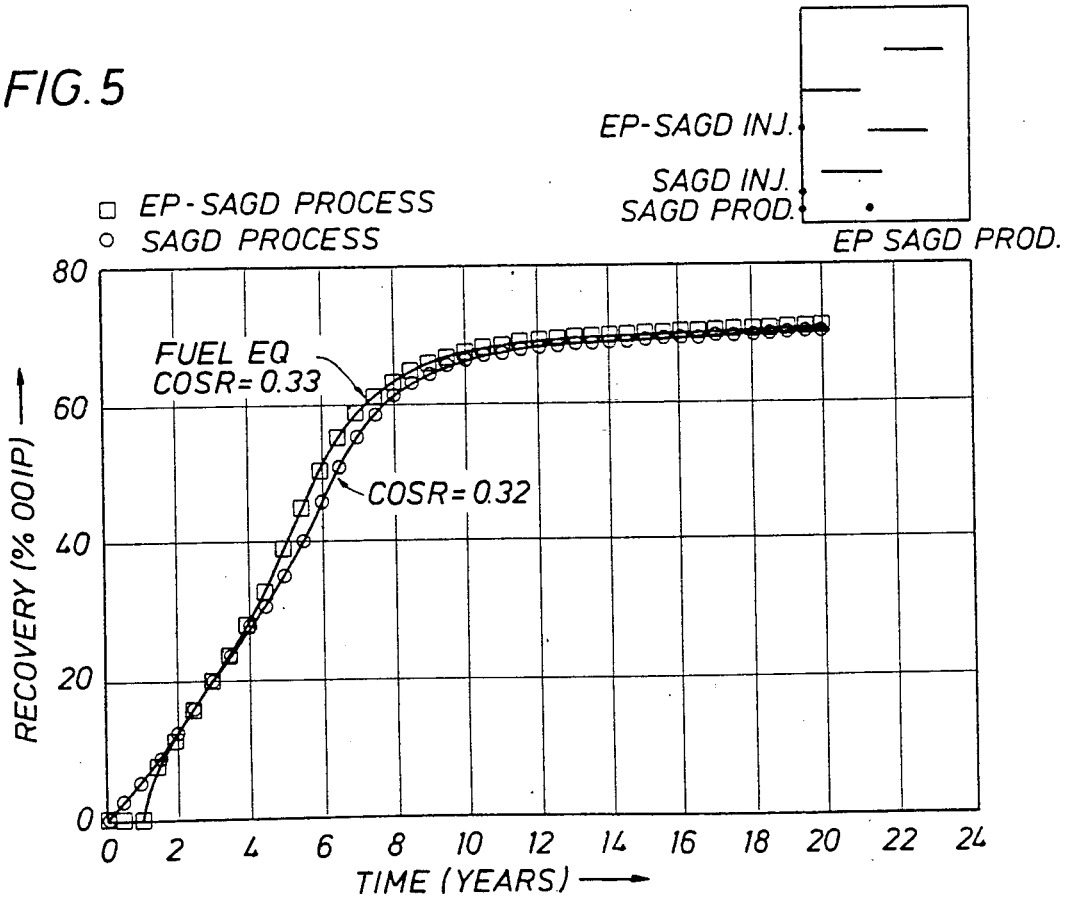
Figure 6:
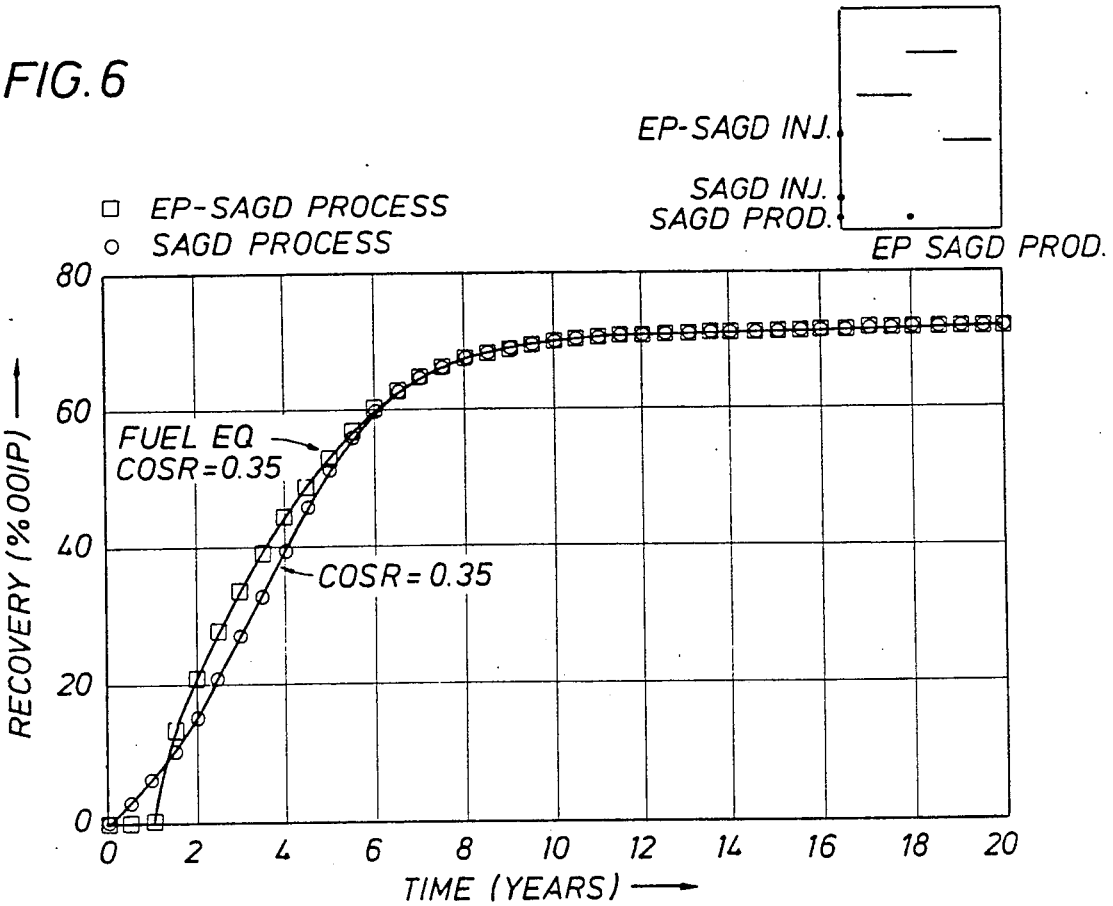
Figure 7:
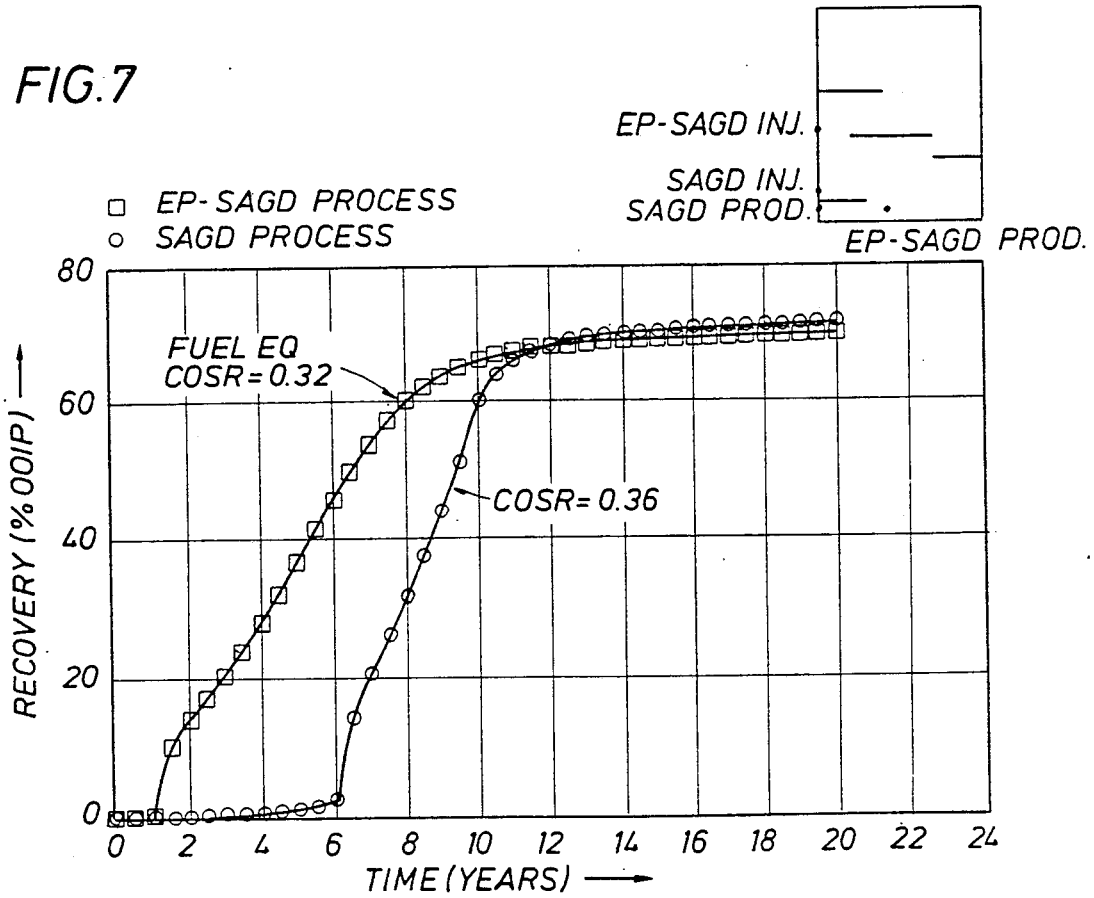
Figure 8:
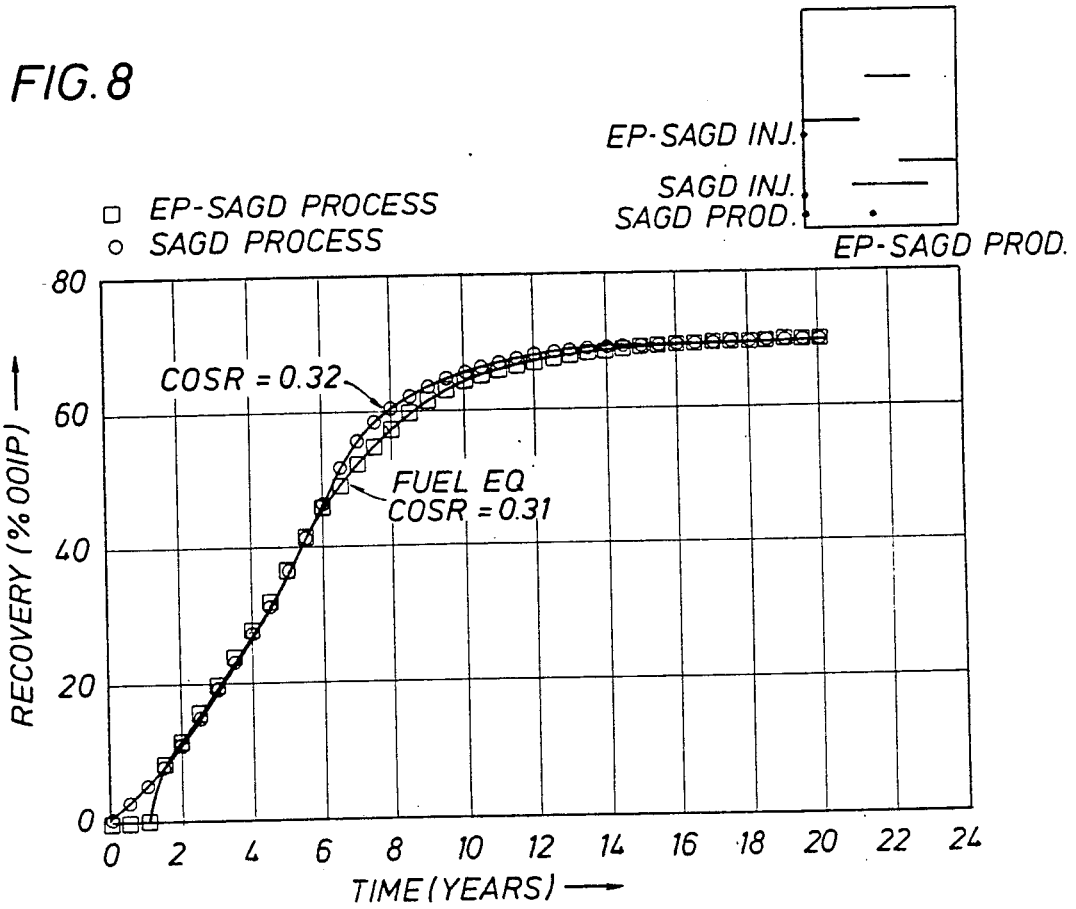
Figure 9:
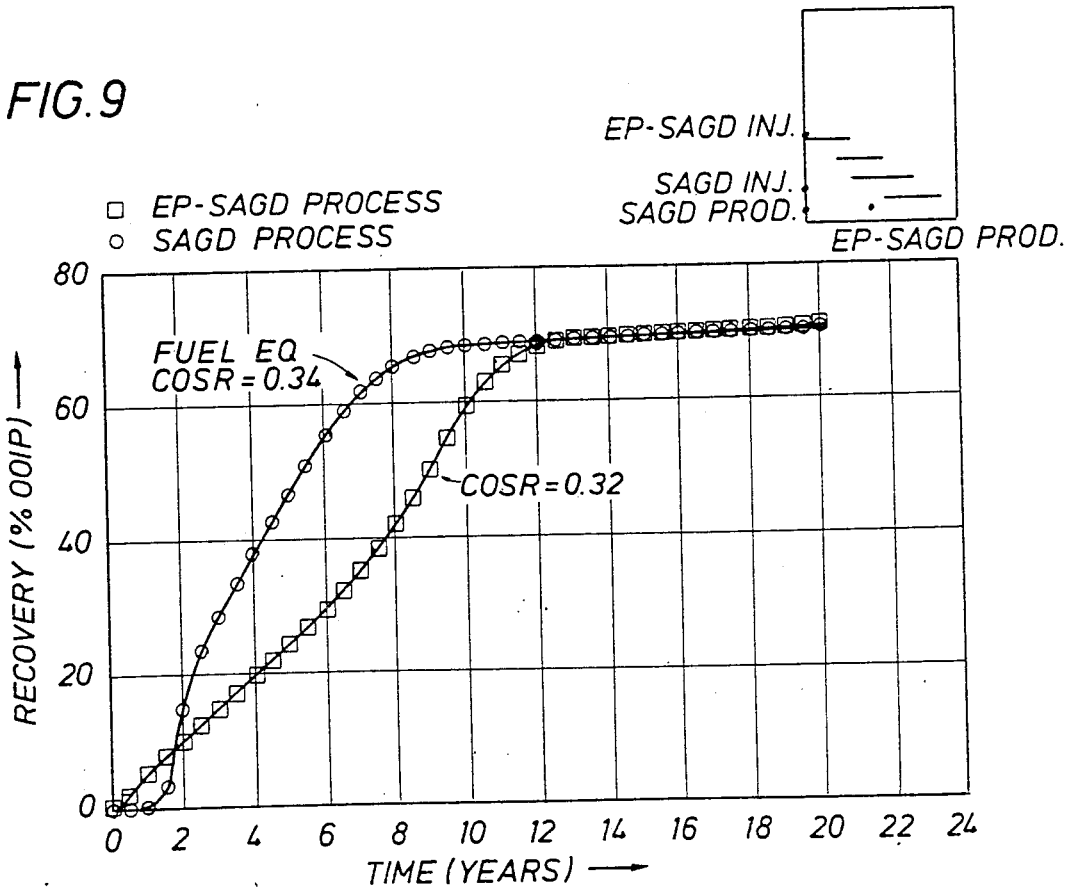
Figure 10:
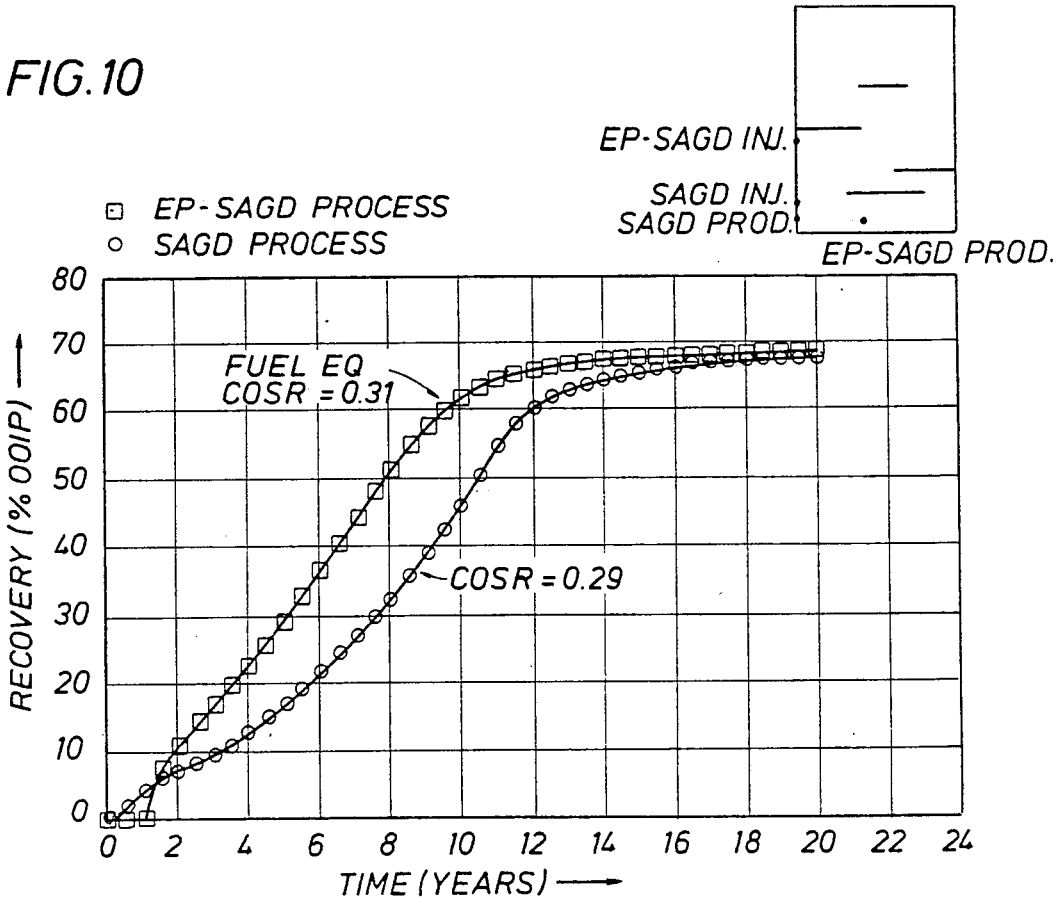
Figure 11:
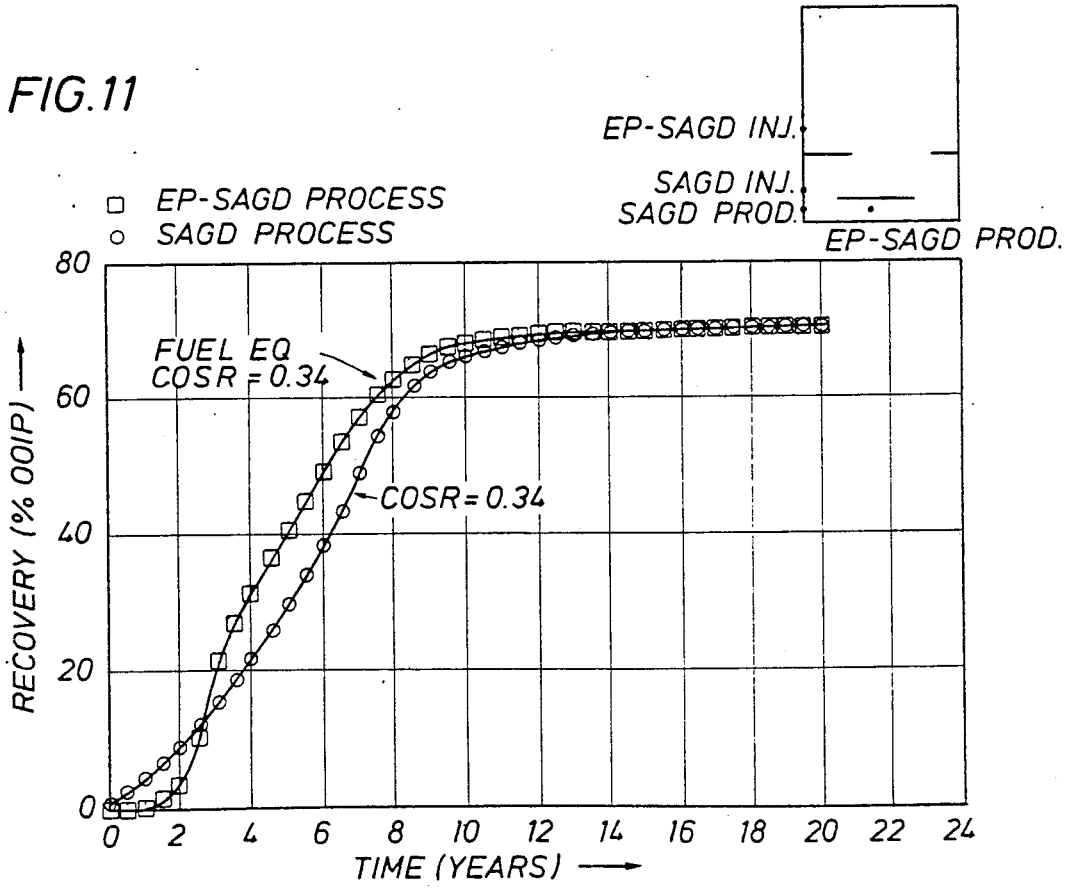

FIG. 3 shows the well configurations that were used in the example for the SAGD and the EP-SAGD processes. In the SAGD process there is only one injector and one producer, with no electrical preheating. Since the EP-SAGD process in this example has 50% more wells (3 as opposed to 2) than the SAGD process, the effective drainage volume of the EP-SADG process must drain at least 50% more volume than the SADG process in a comparable time to compensate for the extra capital. The "steam chests" representing the effective drainage volumes that are developed in the SAGD and the EP-SAGD processes are shown in FIGS. 1 and 2 respectively. Notice that with the EP-SAGD process, the allowable distances between the wells is much greater than in the SAGD process.

FIGS. 4–11 show the results of the comparison runs for various geological settings. Plotted is the recovery of the original oil in place (OOIP) versus time in years. Included in the figures are the geological settings, representing only the right half of the geological setting. The left half of the geological setting is a mirror image of the right half. The results in FIGS. 4–11 show that the SAGD process suffers from significant production delays when shale barriers are present in the vicinity of the wells. The electric heating prior to the steam injection as proposed in the present invention results in an enlarged effective well which makes tar production much less sensitive to the presence of localized shale breaks.

Having discussed the invention with reference to certain of its preferred embodiments, it is pointed out that the embodiments discussed are illustrative rather than limiting in nature, and that many variations and modifications are possible within the scope of the invention. Many such variations and modifications may be considered obvious and desirable to those skilled in the art based upon a review of the figures and the foregoing description of preferred embodiments.

What is claimed is:

1. A process for recovering hydrocarbons from hydrocarbon-bearing deposits comprising:

providing at least two horizontal production wells near the bottom of a target production area, wherein the production wells are horizontal electrodes during an electrical heating stage, and production wells during a production stage;

providing a horizontal injection well essentially centrally located between and above the production wells, wherein the injection well is a horizontal electrode during an electrical heating stage, and an injection well during a production stage;

electrically exciting the electrodes during a heating stage such that current flows between the injection well and the horizontal production wells, creating preheated paths between the injection well and the horizontal production wells having increased injectivity;

injecting through the injection well steam to form a steam vapor containing portion of the formation thereby mobilizing formation oil and permitting the formation oil to flow by gravity to near the bottom of the target production area; and recovering hydrocarbons from the production wells.

2. The process of claim 1 wherein the production wells are separated by between 30 and 200 feet.

3. The process of claim 2 wherein the injection well is from about 30 to about 60 feet above the production wells.

4. The process of claim 3 wherein the production wells are separated by between about 90 and about 120 feet.

5. An apparatus for recovering hydrocarbons from hydrocarbon bearing deposits using an improved steam assisted gravity drainage process, the apparatus comprising:

at least two horizontal production wells near the bottom of a target production area, wherein the production wells are horizontal electrodes during an electrical heating stage, and production wells during a production stage; and a horizontal injection well essentially centrally located between and from about 30 to about 140 feet from the producer wells, wherein the injection well is a horizontal electrode during an electrical heating stage, and an injection well during a production stage.

6. The apparatus of claim 5 wherein the production wells are separated by between about 70 and about 150 feet.

7. The apparatus of claim 6 wherein the injection well is from about 45 to about 60 feet above the production wells.

8. A process for increasing injectivity of hydrocarbon bearing deposits prior to a steam assisted gravity drainage oil recovery process comprising:

providing at least two horizontal production wells near the bottom of a target production area, wherein the production wells are horizontal electrodes during an electrical heating stage;

providing a horizontal injection well essentially centally located between and above the production wells, wherein the injection well is a horizontal electrode during an electrical heating stage; and electrically exciting the electrodes during a heating stage such that current flows between the horizontal injection well and the horizontal production wells, creating preheated paths of increased injectivity.

9. The process of claim 8 wherein the production wells are separated by between about 30 and about 200 feet.

10. The process of claim 9 wherein the injector well is from about 30 to about 60 feet above the production wells.

* * * * *